United States Patent [19]

Brown et al.

[11] Patent Number: 4,641,803

[45] Date of Patent: Feb. 10, 1987

[54] TRACK CIRCUIT

[75] Inventors: Christopher R. Brown; Humphrey Roachsmith, both of Wiltshire, England

[73] Assignee: Westinghouse Brake and Signal Company Limited, Great Britain

[21] Appl. No.: 693,914

[22] Filed: Jan. 23, 1985

[30] Foreign Application Priority Data

Jan. 30, 1984 [GB] United Kingdom ..... 8402359

[51] Int. Cl.[4] ..... B61L 21/00

[52] U.S. Cl. ..... 246/34 CT; 246/63 R; 246/122 R

[58] Field of Search ..... 246/122 R, 34 R, 167 R, 246/63 R, 34 A, 34 CT; 179/82

[56] References Cited

U.S. PATENT DOCUMENTS

| | | | |
|---|---|---|---|
| 3,450,874 | 6/1969 | Whitten | 246/34 CT |
| 3,479,502 | 11/1969 | Whitten | 246/34 R |
| 3,489,892 | 1/1970 | Whitten | 246/34 CT |
| 3,526,378 | 9/1970 | Thorne-Booth | 246/122 R |
| 3,543,262 | 11/1970 | Hutton | 246/34 CT |
| 4,351,504 | 9/1982 | Frielwghaus | 246/122 R |
| 4,487,385 | 12/1984 | Salmon | 246/167 R |

FOREIGN PATENT DOCUMENTS

| | | |
|---|---|---|
| 847177 | 9/1960 | United Kingdom . |
| 1529623 | 10/1978 | United Kingdom . |

*Primary Examiner*—John W. Caldwell, Sr.
*Assistant Examiner*—David A. Okonsky
*Attorney, Agent, or Firm*—Nilsson, Robbins, Dalgarn, Berliner, Carson & Wurst

[57] ABSTRACT

A railway track circuit arrangement particularly suitable for the short track circuit, down to approximately 40 metres, required in metro transit systems. Based on conventional A.C. track signalling principles for continuous track rails, the boundaries between adjacent track sections are defined by electric separation zones. An electrical short is connected between the running rails and an A.C. signal tuning unit is connected approximately 6 metres away to tune the end loop thus formed to resonance at the selected track signal frequency. The tuning units comprise a capacitor, the value of which is selected for resonance tuning, and a transformer a winding of which is connected in series with the capacitor, and a track circuit signal transmitter or receiver is connected through a second winding of the transformer. In order to reduce mutual coupling between track circuits by longitudinal leakage, in each joint, two electrical short may be connected between the rails spaced apart approximately 0.75 metre.

5 Claims, 6 Drawing Figures

TRACK CIRCUIT

Figure 1:
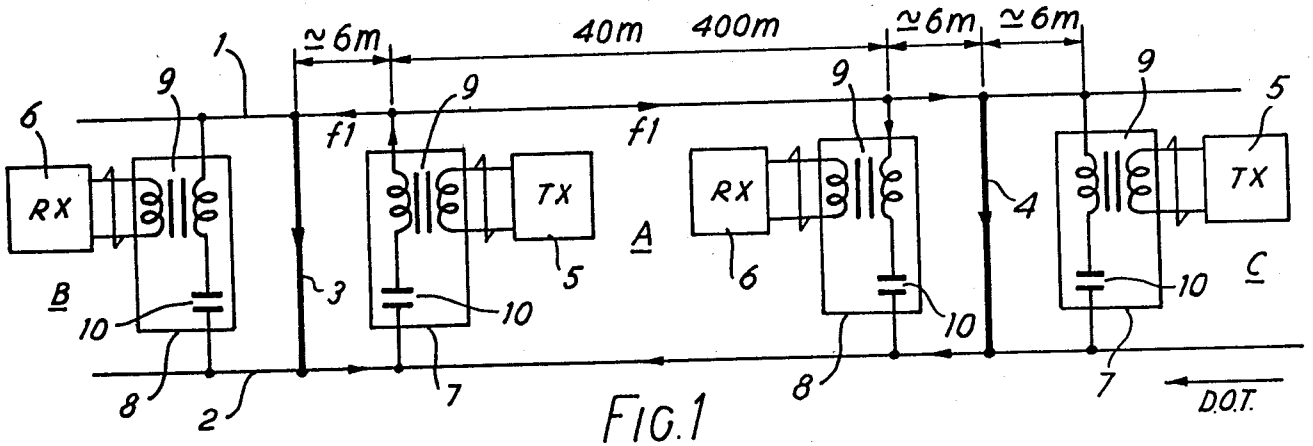

The invention relates to railway track arrangements suitable for relatively short track sections such as found on metro and mass transit railway systems, and sometimes on main line sections.

There are several types of railway track circuits. The present invention is concerned with jointless A.C. track circuits, particularly intended for use with A.C. and D.C. electric traction. The jointless track circuit is so called because the running rails are continuously welded to eliminate noisy and troublesome insulating joints of earlier forms of track circuit. Instead of these insulating joints, tuning units connected between the rails at opposite ends of a track circuit resonate at the characteristic frequency of the track circuit to define the boundaries between adjacent circuits.

For normal main line work this type of track circuit provides satisfactory working with characteristics which allow track circuit lengths of between 150 meters and 1 kilometer with end-fed track circuit signals. On main line railway tracks there is rarely a requirement for track circuits shorter than about 200 meters and the normal length is usually considerably greater because of the considerable headway distance between trains and the relatively long length of the trains themselves. However, in the case of suburban railway, mass transit systems and underground railways shorter trains and considerably shorter headway distances demand track circuit lengths as short as 40 meters.

Scaled down main line jointless track circuits are unsatisfactory because the minimum joint length, or electric separation region between adjacent circuits, is too long at 20 meters and if the tuning units are positioned closer together, at say 6 meters which is more suitable for metro track circuits, cross coupling between the units becomes significant, the effect being to flatten the frequency response characteristic of the tuning unit and to shift the resonant frequency.

The present invention is intended to provide a railway track circuit arrangement particularly suited for use in short track sections and which does not possess the drawbacks mentioned above.

According to the present invention there is provided a railway track circuit arrangement of the kind in which an A.C. signal is carried by electrically continuous track rails which are electrically divided into track circuit sections by means connected across the rails spaced apart at intervals along the track, each of said means defining an A.C. signal separation zone between adjacent sections, and comprising electrical shorting means connected between the running rails and frequency tuning means connected between the running rails on either side of the electrical shorting means and spaced at short distance therefrom, the tuning means being arranged to tune an end loop in each track section, which end loop including the tuning means the shorting means and an intermediate short length of rails, to resonate at a frequency selected for the A.C. signal frequency in that section, said tuning means including a capacitive component and an inductive component provided by a first winding of a transformer, a second winding of which is connected to a track circuit signal transmitter or track circuit signal receiver.

A preferred embodiment of the invention will now be described, by way of example only, with reference to the accompanying drawings.

Figure 1A:
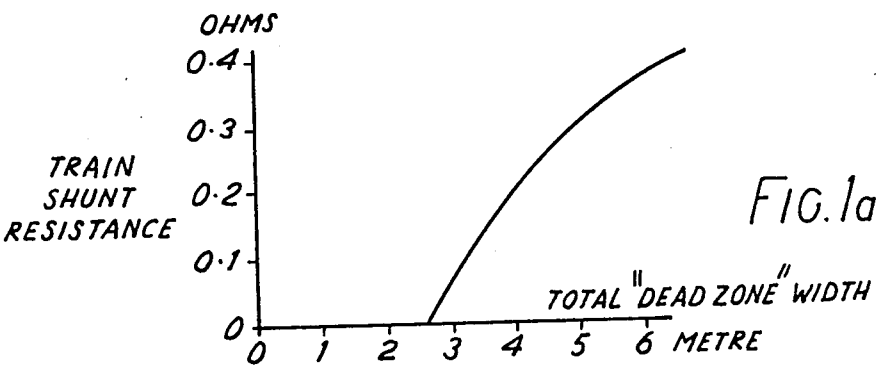
Figure 2:
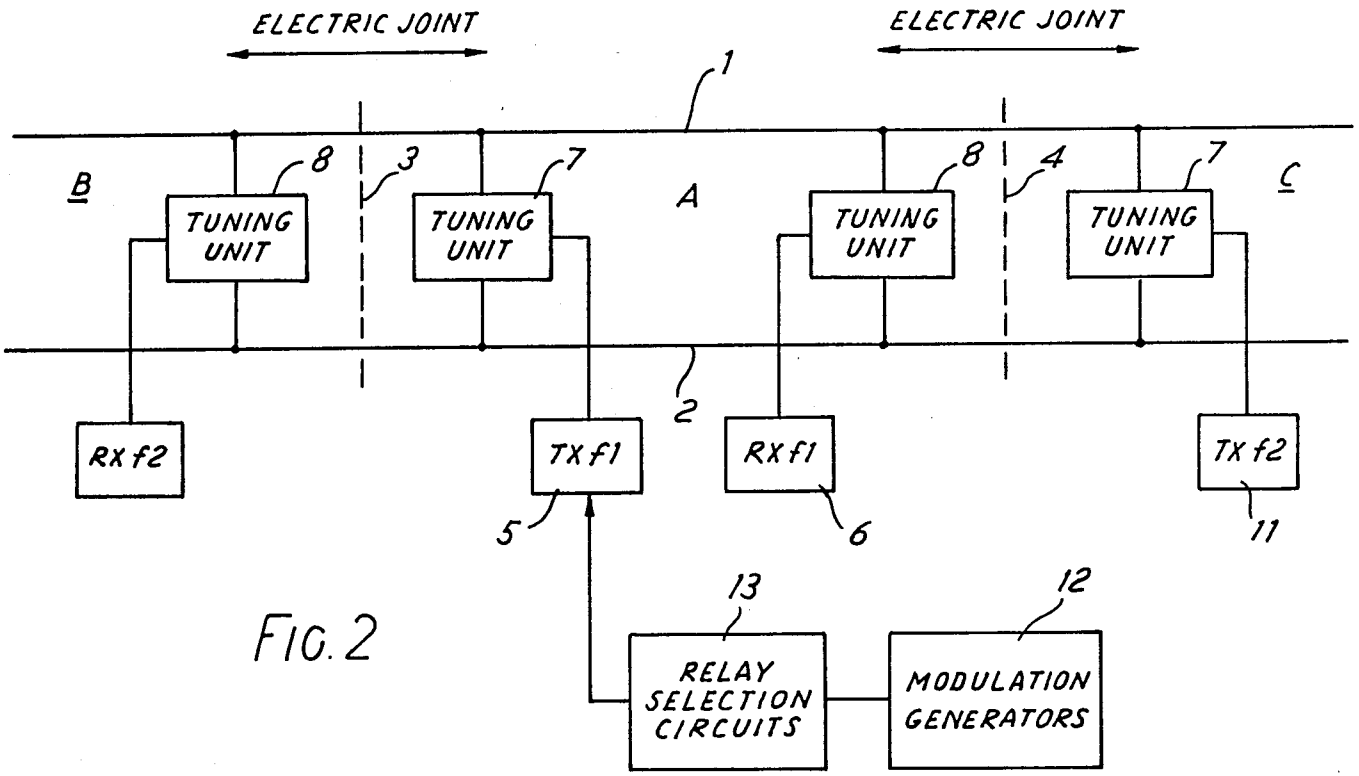
Figure 3:
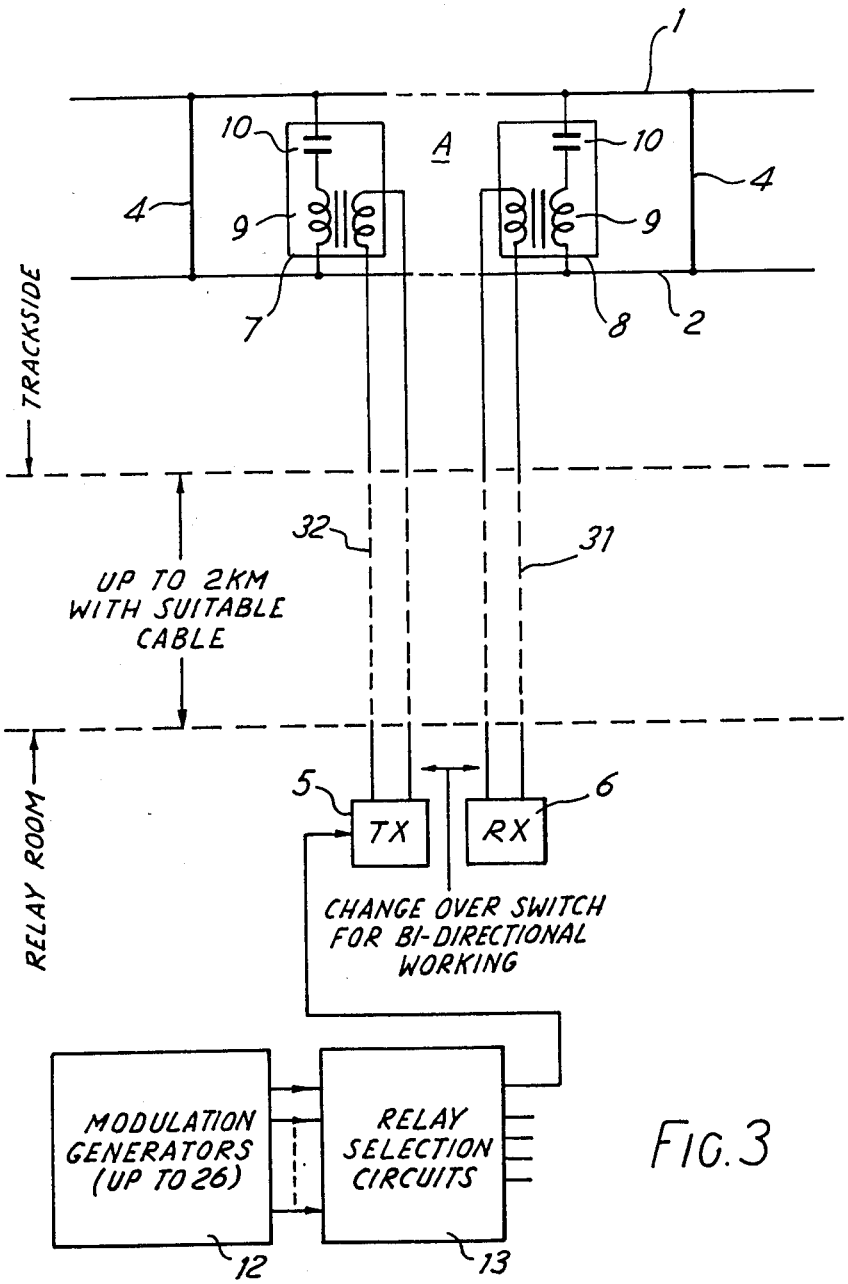
Figure 4:
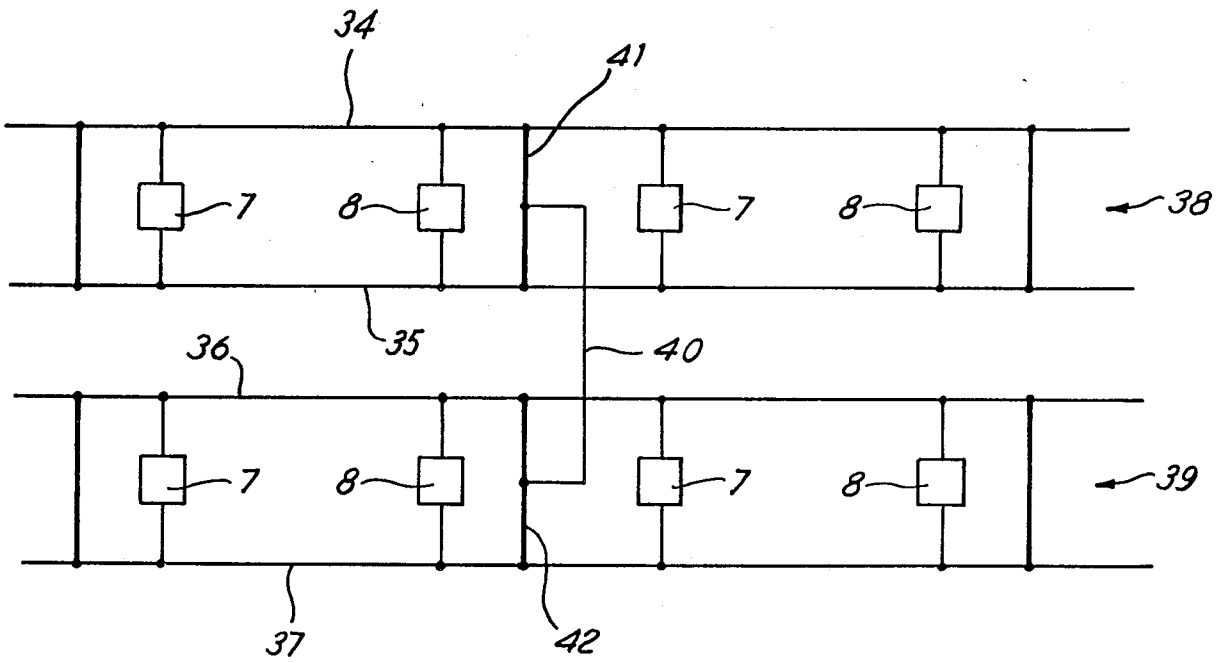
Figure 5:
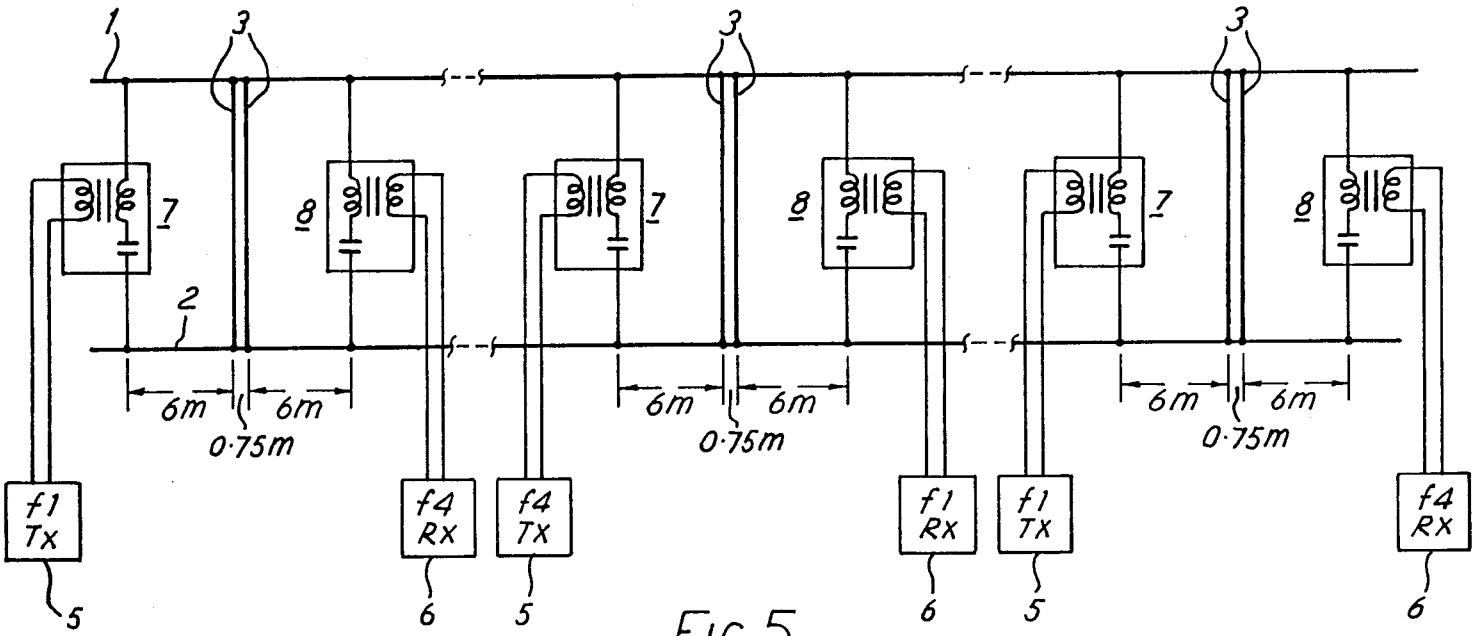

FIG. 1 shows a schematic diagram of a metro track circuit,

FIG. 1*a* shows a graph of the relationship between the width of the zone between adjacent track circuits and train shunt resistance, FIG. 2 shows a block diagram of the track circuit arrangement of FIG. 1 with provision for A.T.P. coding of the track circuit signal, FIG. 3 shows a block diagram of the arrangement of FIG. 2 in a centralised traffic control system, FIG. 4 shows a simplified cross bonding permitted by the invention, and FIG. 5 shows a modified form of the track circuit arrangement of FIG. 1 having reduced longitudinal leakage properties.

Referring now to FIG. 1, there is illustrated a complete track circuit section A and the adjacent ends of neighbouring track circuit sections B and C. The running rails of the railway track are shown at 1 and 2 and these are bridged at predetermined intervals by short-circuit bonds 3 and 4 which define the boundaries between adjacent track circuit sections. Towards opposite ends of each section tuning units 7 and 8 are also connected between the rails and spaced short distances (approx 6 meters in the embodiment being described) inside the track circuit boundaires. A track circuit transmitter 5 and a track circuit receiver 6, which are both of conventional configuration, are connected to opposite ends the track sections via these tuning units 7 and 8.

The track circuit transmitter 5 and receiver 6 are both connected to the rails 1 and 2, at opposite ends of the section, via transformers in tuning units 7 and 8. These units consist of a transformer 9 and a capacitor 10 connected in series with a first winding of the transformer, which, together with lengths of the rails 1, 2 lying between the tuning units and the bonds 3 and 4, form tuned circuits at opposite ends of the track section. The track circuit transmitter is connected to a second winding of the transformer in one tuning unit 7 and the track circuit receiver is connected to a second winding of the transformer in the opposite tuning unit 8. The tuning units 7 and 8 are spaced from the shorting bonds 3, 4 by approximately 6 meters in all cases and tuning of the end loop resonant frequencies to different track circuit frequencies is achieved by the use of different values of capacitors.

In the described arrangement, the track circuit signal is fed into and received from the track section through a transformer winding connected in series with a capacitor, thus, the track circuit is terminated with a parallel resonant circuit whereas the track circuit signal is coupled into the circuit via a series resonant circuit. Since the inductive impedance of the transformer, the resistance of the rail sections between the tuning units and the shorting bonds, and the bonds themselves form a very low impedance, at audio frequencies, considerable power is drawn from the transmitters 5. This high power loss is reduced to an acceptable level by the method of resonating the section end loops using capacitors to tune to parallel resonance.

Preferably the shorting means comprises a rectilinear conductor, of substantial current carrying capacity, connected perpendicularly between the running rails of a track, for example a metal bar or rod of good conducting material bolted or riveted at opposite ends to the flange or foot of the rails. These conductors may be positioned conveniently to coincide with the members, or railway sleepers, which support the running rails on the railway track bed, and, in that case, may be secured to the supporting members or located within the members, that is the main body of the conductor is contained within the member for additional security.

The tuning units which, as mentioned above include a capacitor and a transformer, are preferably constructed as individual units adapted for mounting in or on the railway track bed, that is, they may be mounted between, or next to, the running rails and on the surface of the ballast or buried in the ballast, depending mainly upon if the unit is air-cooled or cooled by a contained medium such as oil. The unit is arranged so that the capacitor is dismountable, at least during initial assembly and testing, so that capacitors of alternative values may be fitted in accordance with the value of capacitance required to resonate an end loop at a selected track circuit frequency.

The described track circuit has been found suitable for use with frequencies in the audio range of 4 to 6 KHz, or lower, and for track circuit lengths of from 40 meters to 400 meters, which adequately covers the range required in metro rail systems and the like.

The described track circuit arrangement with shorting bonds at the track section terminations possesses a "dead zone" extending for a short distance on either side of the shorting bond, within this zone the track circuit is not capable of detecting a single vehicle axle shunt. The "dead zone" may also be referred to as the "electrical joint". The width of this dead zone or electrical joint is primarily dependent on the Q factor of the parallel resonant circuit formed by the end loop comprising tuning unit, a shorting bond and the inter-connecting lengths of rail. There is shown in FIG. 1*a* a graph illustrating the variation of dead zone width against the shunt resistance provided by a vehicle axle.

Thus, providing a vehicle in a track section has an inter-axle spacing greater than the dead zone width corresponding to the shunt resistance of its axles then it will be continuously and positively detected as it moves along a track passing from one track section to another. It will be seen from the graph that the theoretical minimum dead zone width is approximately 2.5 meter although a typical dead zone width is not less than 3 meter.

FIG. 2 shows the positioning of the tuning units for a succession of track circuits, in track circuits "A" in the centre of the drawing the allocated track circuit signal frequency is f1 and the transmitter and receiver tuning units 7 and 8 respectively are positioned inside the shorting bars 3 and 4 defining the boundaries adjacent track circuits "B" and "C". In the example both adjacent track circuits are tuned to a frequency f2 and their respective tuning units are likewise positioned within their respective track circuit boundaries. The arrangement shown in FIG. 2 is also used to transmit automatic train protection information to the train using the track circuit signal as a coded carrier signal. For this purpose a conventional modulation generator 12 and relay selection circuit 13 are connected to the transmitter 5 of track circuit A. A further modulation generator may be connected to a relay selection circuit (not shown) for the purpose of selectively conveying a number of different coded commands to a train. Each modulation generator may be capable of driving a number of transmitters so that a single modulation code may be carried simulaneously by several track circuits.

The simple form of tuning circuit employed in the invention is capable of producing a high Q factor and possesses inherently good tuning characteristics. Consequently, at the resonant track frequency and for a given transmitter input power, the track circuit according to the invention provides a substantially greater power output at the receiver than if it were not tuned. Therefore, it is possible to transmit the track circuit signals over greater cable distances making it possible to position all essential equipment in a satellite relay room or interlocking room rather than in track side cabinets dispersed along the length of signalled track. FIG. 3 schematically illustrates the newly possible division of apparatus between trackside and relay room locations.

Basically FIG. 3 shows the same track circuit arrangement as FIGS. 1 and 2 but, because of the improved dynamic performance of the arrangement the transmitter 5 and receiver 6 are located in a relay room which can be up to 2 kilometers distant from the track circuit A, in question. Thus, the electronic equipment may be located in relatively safe surroundings and not adjacent the track, which may run through an underground railway tunnel. The tuning units 7 and 8, and the transformers which couple the track circuit signals to the rails 1 and 2 are fed via cables 31 and 32 which, adequately shielded from interference, are routed to the room having the receiver and transmitter.

The simple shorting bond arrangement of the invention, which requires only a direct connection between the running rails, offers the advantages of excellent equalisation of traction return current in the rails at the end of every track circuit, which in turn reduces to a minimum the level of traction interference voltage appearing across the track circuit equipment. Also, it dispenses with the need for special impedance bonds by allowing cross-bonding between tracks or roads simply by connecting together the centres of respective shorting bonds.

Thus, cross-bonding between railway tracks is greatly simplified by the invention, as illustrated in FIG. 4, since all that is now necessary to share traction current returns equally between running rails 34, 35 and 36, 37 of adjacent tracks is to connect together the shorting bars of the adjacent tracks 38 and 39 by cables 40 connected between the centres of the bars 41 and 42. It is not necessary to connect every shorting bar to its neighbour in an adjacent railway track and the conventional practice of connecting together only occasional impedance bonds is followed. Preferably, the ends of track sections in neighbouring and cross-bonded tracks, at least those which are bonded together, are substantially aligned in order to minimise the lengths of cross-bonding connections.

The track circuit arrangement illustrated in FIG. 5 in which like parts are given the same reference as FIG. 1, is adapted to tackle the problem of longitudinal leakage due to mutual coupling between track circuits of the same frequency. The electrical shorting means defining the ends of a track section comprise two shorting connections 3 between the rails 1, 2 spaced apart at approximately 0.75 meter. Conveniently these shorting connections may be aligned with two adjacent rail bearing members or sleepers, which have approximately the same spacing. The connections may be attached to the member or even contained within the main body of the member for increased protection.

The use of a double bond arrangement increases the length of the dead zone in the electrical separation region between adjacent track circuits by approximately the same spacing as the shorting connections. Thus, effectively shifting the curve of FIG. 1*a* towards the right, in the graph, by a distance equal to the inter-short spacing.

The physical and electrical constructions of a track circuit arrangement having a double shorting means is otherwise the same as previously described with reference to the single shorting means. Thus, the track circuit transmitters and receivers are connected by means of coupling transformers in the tuning units which also provide the inductive components of the tuning units.

We claim:

1. A railway track circuit arrangement of the kind used for railway vehicle detection in which an electrical A.C. signal of predetermined frequency is carried by the track rails to establish one or more track circuits in said track rails, said track rails being electrically continuous with each of said track circuits being electrically isolated from said other track circuits in adjacent track sections by an A.C. electrical signal separation zone, said zones at opposite ends of each of said track sections and spatially separated along said track by a first distance equal to the length of the intervening track circuit section, each of said signal separation zones being defined by, in combination, electrical shorting means connected between said track rails, a capacitor and an inductor in series also connected between said rails at points on opposite sides of said shorting means and spaced therefrom by a second distance, said second distance being substantially shorter than said first distance and selected to provide that an electrical signal loop formed at one end of said track section by the respective shorting means, capacitor, inductor and intermediate lengths of said track rails is resonant at a predetermined signal frequency of said section, and wherein said shorting means consists of a pair of low impedance conductors connected between said track rails at points spaced from each other by a third distance.

2. A railway track circuit according to claim 1, wherein electrical cross bonding between said track rails is achieved by joining together one or more of said conductors which comprise said shorting means.

3. A railway track circuit according to claim 2 wherein said one or more conductors are joined substantially at their midpoints.

4. A railway track circuit according to claim 1 wherein said two conductors are spaced apart by a distance of substantially 0.75 meters.

5. A railway track circuit according to claim 4 wherein the shorting means is secured to, or located in, a member supporting the track rails.

* * * * *